US011754362B2

(12) United States Patent
Termanini

(10) Patent No.: US 11,754,362 B2
(45) Date of Patent: Sep. 12, 2023

(54) DEVICE FOR MITIGATING FIREARM RECOIL

(71) Applicant: Zafer Termanini, Port Saint Lucie, FL (US)

(72) Inventor: Zafer Termanini, Port Saint Lucie, FL (US)

( * ) Notice: Subject to any disclaimer, the term of this patent is extended or adjusted under 35 U.S.C. 154(b) by 0 days.

(21) Appl. No.: 17/947,215

(22) Filed: Sep. 19, 2022

(65) Prior Publication Data

US 2023/0168059 A1 Jun. 1, 2023

(51) Int. Cl.
*F41A 21/36* (2006.01)

(52) U.S. Cl.
CPC ..... *F41A 21/36* (2013.01)

(58) Field of Classification Search
CPC ..... F41A 21/36
USPC ..... 42/1.06
See application file for complete search history.

(56) References Cited

U.S. PATENT DOCUMENTS 3,650,060 A * 3/1972 Schubert ..... F41A 3/82 42/1.06
4,492,050 A * 1/1985 Kagehiro ..... F41A 21/28 42/1.06
4,503,632 A * 3/1985 Cuevas ..... F41A 21/28 42/1.06
5,076,137 A * 12/1991 Paredes ..... F41A 21/36 89/14.3
5,909,002 A * 6/1999 Atchisson ..... F41A 3/70 42/1.06
6,901,689 B1 * 6/2005 Bergstrom ..... F41A 3/92 42/1.06
11,365,945 B2 * 6/2022 Geissele ..... F41A 5/26
2017/0314883 A1 * 11/2017 Whitfield, Jr. ..... F41A 21/38
2019/0204046 A1 * 7/2019 Calvete ..... F41C 23/16

* cited by examiner

*Primary Examiner* — Samir Abdosh
(74) *Attorney, Agent, or Firm* — Samir Termanini, Esq.

(57) ABSTRACT

A device for reducing a recoil force generated by firing of a firearm. The device comprises elongated chamber in the form of an outer cylinder concealed in the forend of a long firearm and having a communicating port with the barrel of the gun situated a short distance beyond the tip of the bullet. The outer cylinder comprising a lead filled cylinder sliding freely back and forth into the elongated chamber. Upon firing the gun, a portion of the explosion gases will penetrate through the communicating Port into the recoil reducing cylinder and forcefully push the lead field cylinder forward against the distal bumper therefore pulling the gun forward and dampening the recoil force. After firing a spring situated distal to the lead cylinder pushes the cylinder backward to its initial position.

6 Claims, 3 Drawing Sheets

DEVICE FOR MITIGATING FIREARM RECOIL

The present invention relates to firearms and more particularly to a device used to reduce and dampen recoil force generated by discharge of a firearm.

BACKGROUND OF THE INVENTION

When a firearm is discharged a rearward momentum, referred to as recoil, is generated. equivalent to the forward momentum of the projectile and the exhaust gases. Said backward momentum is transferred to the shooter's shoulder causing him discomfort or pain. When firing large caliber rifles, said backward momentum can be considerable and may cause physical damage to the shoulder anatomy including broken collar bone or dislocated shoulder. Multiple attempts have been made by the gun industry take me to mitigate the recoil momentum by adding recoil pad to the butt of the gunstock and considerable number of muzzle brake aim to redirect the exhaust gases. However, this has resulted in minimal reduction in the recoil momentum since it only addresses the consequence without affecting the actual recoil generation.

The present disclosure addresses the problem by providing a recoil reducing device aimed to reduce recoil forces transmitted to the shooter arms and shoulder as soon as they are generated so that the shouter will experience a recoil momentum that is significantly reduced.

SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

The present disclosure describes a system for reducing recoil force transmitted from the firearm to the shooter's arms and shoulder. In one embodiment, the system is incorporated into the forend (also known as the fore-end, handguard or forestock) of the firearm and firmly attached to the gun barrel through permanent welding process or through detachable brackets. The system includes an outer cylinder longitudinally placed under the barrel of the gun. Said cylinder has a communicating port with the barrel of the gun situated proximally at a distance distal to the tip of the bullet. The system further includes a movable sliding cylinder filled with lead and situated within the outer cylinder. A spring situated distal to the internal lead cylinder will allow said lead cylinder to return backward to an its initial pre-firing position.

Upon firing the gun, explosion gases will push the bullet through the barrel past the communicating Port. Portion of the gases will penetrate the outer cylinder through the communicate import and violently push the lead cylinder forward against the distal bumper and this will subsequently create forward impact momentum which will pull the gun forward and counteract that backward recoil force. Subsequent of the described event, the lead cylinder will be pushed backward by the spring and the residual explosion gases will exit through the communicating port into the empty barrel.

Embodiments of the present disclosure may include a recoil reducing device secured to a barrel of a firearm, the recoil reducing device including an outer cylinder secured to the barrel of the firearm. Embodiments may also include a weighted cylinder. Embodiments may also include a distal bumper. Embodiments may also include a rear bumper. Embodiments may also include a return spring disposed within the outer cylinder for biasing the weighted cylinder toward rear bumper. Embodiments may also include a communicating port. In some embodiments, the communicating port forms a gas channel between the barrel and the outer cylinder.

In some embodiments, the weighted cylinder may be slidably disposed within the outer cylinder so that the return spring may be compressed whenever the weighted cylinder glides toward the distal bumper and the return spring tension may be released whenever the weighted cylinder glides toward the rear bumper. In some embodiments, the communicating port may be configured to allow discharge gases to penetrate the outer cylinder and push the weighted cylinder to accelerate until the weighted cylinder forcefully strikes the distal bumper.

In some embodiments, the recoil reducing device may include an exit port situated distal to the weighted lead cylinder allow gases in front of the lead weighted cylinder to exit as the lead cylinder may be pushed forward. In some embodiments, the hollow outer cylinder may be situated in a parallel position to the gun barrel and firmly attached to it via one or more welding points. In some embodiments, the hollow outer cylinder can be attached to the gun barrel removable bracket allowing the hollow out of cylinder to be removed for maintenance.

These and various other advantages, features, and aspects of the present invention will become apparent and more readily appreciated from the following detailed description of the embodiment taken in conjunction with the accompanying drawings, as follows.

BRIEF DESCRIPTION OF THE DRAWINGS

The drawing figures depict one or more implementations in accord with the present teachings, by way of example only, not by way of limitation. In the figures, like reference numerals refer to the same or similar elements. Furthermore, the drawings are not necessarily to scale.

Figure 1:
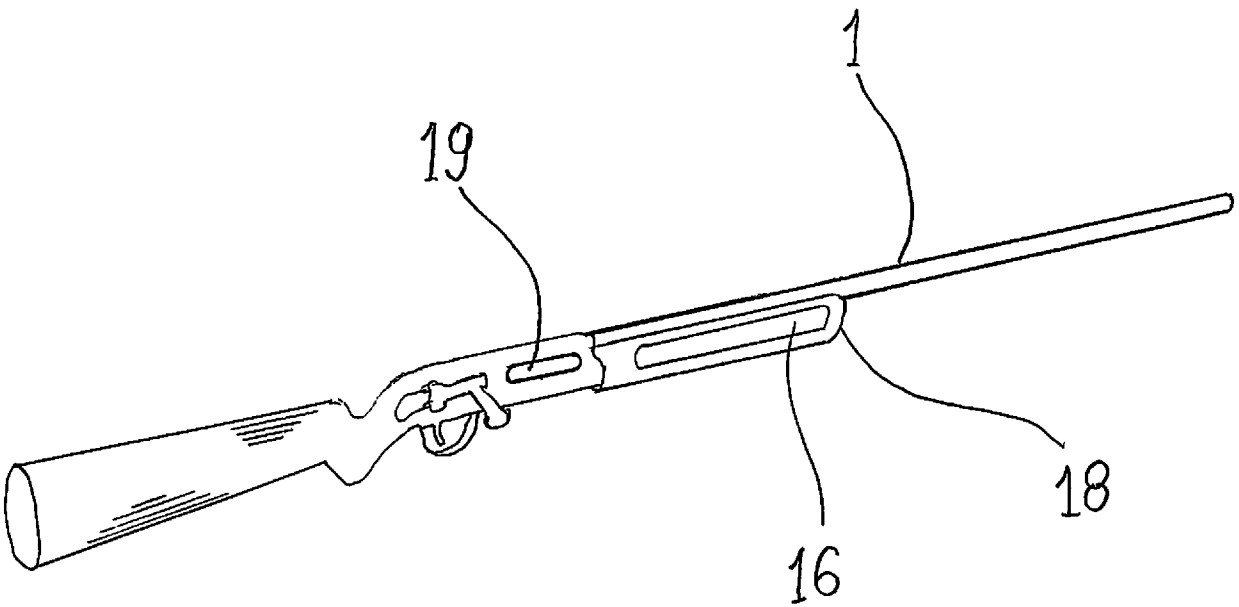
FIG. 1 is a perspective side view of a long firearm depicting the forend.

This disclosure includes references to "one embodiment" or "an embodiment." The appearances of the phrases "one embodiment" or "an embodiment" do not necessarily refer to the same embodiment. Particular features, structures, or characteristics may be combined in any suitable manner consistent with this disclosure.

DETAILED DESCRIPTION OF THE PRESENT INVENTION

For the purposes of promoting an understanding of the principles in accordance with the embodiments of the present invention, reference will now be made to the embodiments illustrated in the drawings and specific language will be used to describe the same. It will nevertheless be understood that no limitation of the scope of the invention is thereby intended. Any alterations and further modifications of the inventive feature illustrated herein, and any additional applications of the principles of the invention as illustrated herein, which would normally occur to one skilled in the relevant art and having possession of this disclosure, are to be considered within the scope of the invention claimed.

FIG. 1 shows a long firearm with which the embodiments of the present invention may be used. The long firearm has a cartridge ejection port 19 and a forend 18 which comprises an outer cylinder 16.

Figure 2:
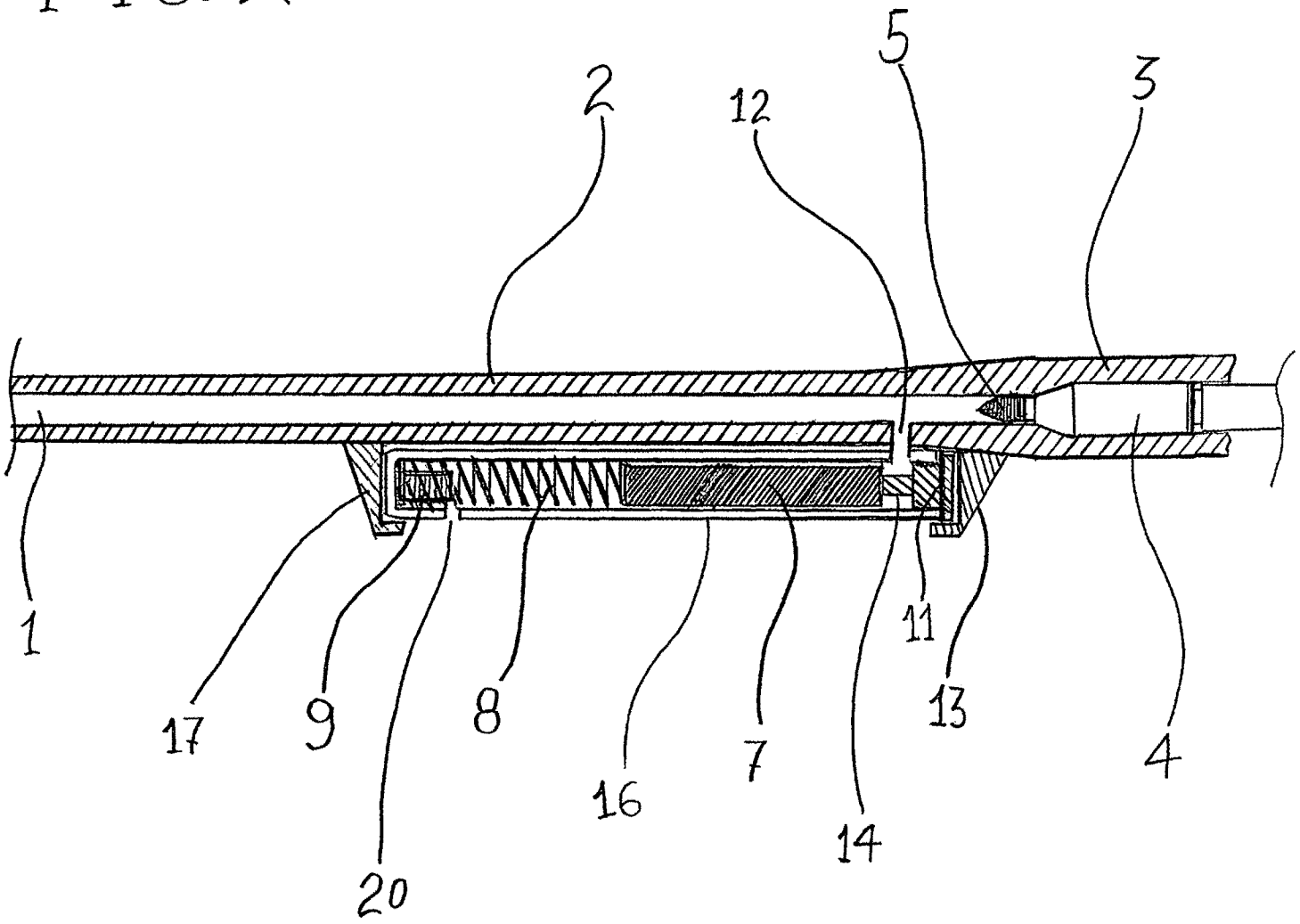
FIG. 2. is a side sectional view at the level of the forend of the long firearm of FIG. 1, according to one embodiment.

FIG. 2 shows a side sectional view at the level of the forend a long firearm according to the embodiments of the present invention.

Prior to firing, lead cylinder 7 is held against rear bumper 14 located at the back of outer cylinder 16 by return spring 8. Upon firing cartridge 4 loaded in chamber 3, the ignition of the gun powder generates explosion gases that push projectile 5 throughout gun barrel 2. As projectile 5 leaves cartridge 4 and begins to pass through gun barrel 2, a portion of the explosion gases begin to penetrate into outer cylinder 16 through communicating port 12. The explosion gases go around rear bumper 14 and push lead cylinder 7 forward, causing lead cylinder 7 to advance toward and forcefully strike distal bumper 9 (which is solidly attached to distal threaded plug 10.) Exit port 20 allows air in the path of lead cylinder 7, as it moves forward, to escape.

The impact of lead cylinder 7 against distal bumper 9 creates a forward impact momentum that will pull the gun forward and counteract the backward recoil force results. The result is a significant reduction in backward recoil momentum generated by firing. cartridge 4. After lead cylinder 7 impacts distal bumper 9, return spring 8 pushes lead cylinder 7 back to its initial resting position against rear bumper 14. Any residual explosion gases situated behind lead cylinder 7 subsequently escape through communicating port 12 back into gun barrel 2 and exit through muzzle 1. In one embodiment, outer cylinder 16 is attached by solid weld 15 to gun barrel 2.

Figure 3:
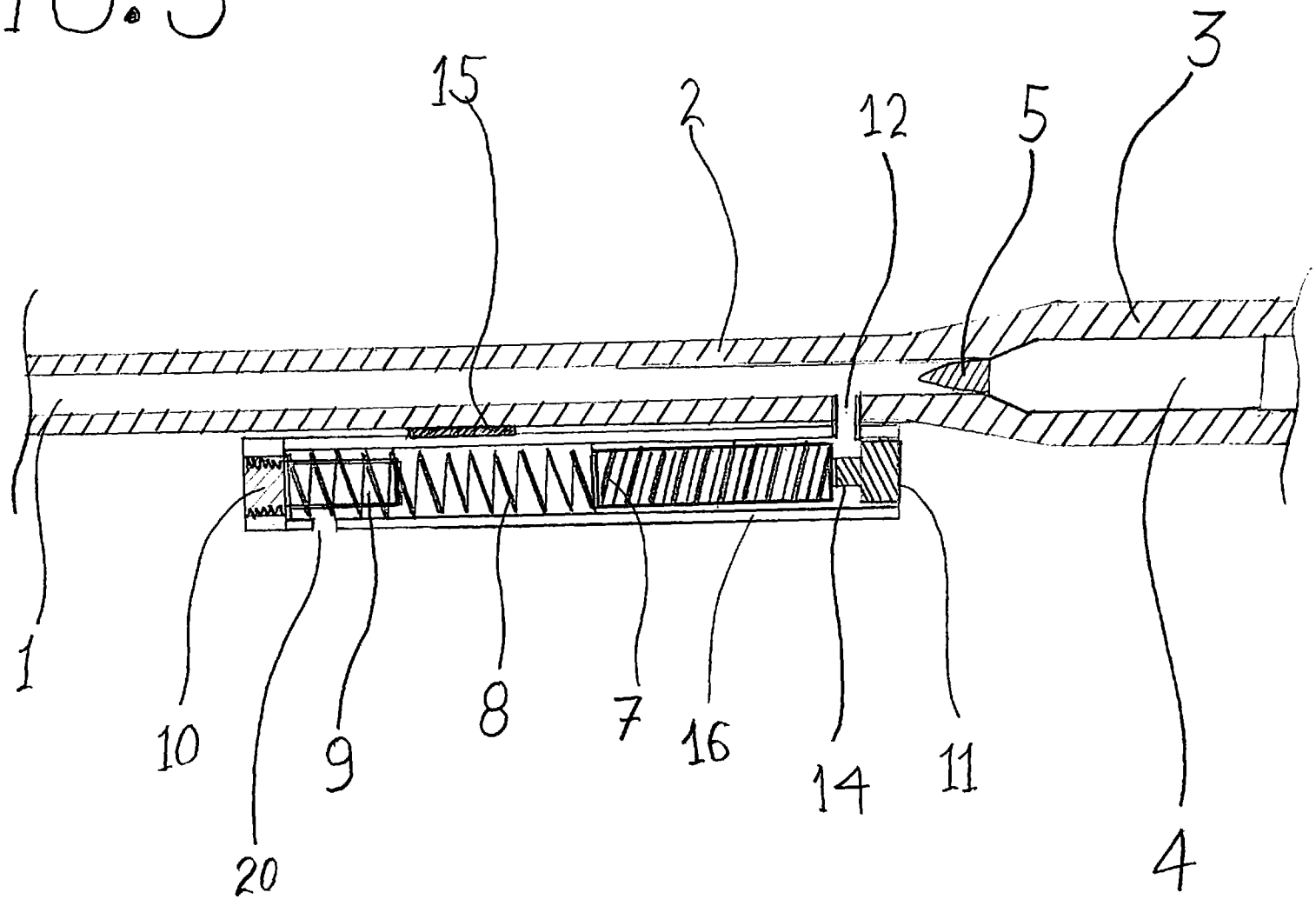
FIG. 3. is sectional side view at the level of the forend of the long firearm of FIG. 1, according to one embodiment.

In another embodiment, as shown in FIG. 3, outer cylinder 16 is attached to gun barrel 2 using rear bracket 13 and front bracket 17, thereby permitting outer cylinder 16 to be removable, making maintenance or replacement easier.

What has been described and illustrated herein is an example along with some of its variations. The terms, descriptions and figures used herein are set forth by way of illustration only and are not meant as limitations. Many variations are possible within the spirit and scope of the subject matter, which is intended to be defined by the following claims, and their equivalents, in which all terms are meant in their broadest reasonable sense unless otherwise indicated.

While various implementations have been described, the description is intended to be exemplary, rather than limiting, and it is understood that many more implementations and implementations are possible that are within the scope of the implementations. Although many possible combinations of features are shown in the accompanying figures and discussed in this detailed description, many other combinations of the disclosed features are possible. Any feature of any implementation may be used in combination with or substituted for any other feature or element in any other implementation unless specifically restricted. Therefore, it will be understood that any of the features shown and/or discussed in the present disclosure may be implemented together in any suitable combination. Accordingly, the implementations are not to be restricted except in light of the attached claims and their equivalents. Also, various modifications and changes may be made within the scope of the attached claims.

Except as stated immediately above, nothing that has been stated or illustrated is intended or should be interpreted to cause a dedication of any component, step, feature, object, benefit, advantage, or equivalent to the public, regardless of whether it is or is not recited in the claims.

It will be understood that the terms and expressions used herein have the ordinary meaning as is accorded to such terms and expressions with respect to their corresponding respective areas of inquiry and study except where specific meanings have otherwise been set forth herein. Relational terms such as first and second and the like may be used solely to distinguish one entity or action from another without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a" or "an" does not, without further constraints, preclude the existence of additional identical elements in the process, method, article, or apparatus that comprises the element.

The scope of the present disclosure includes any feature or combination of features disclosed herein (either explicitly or implicitly), or any generalization thereof, whether or not it mitigates any or all of the problems addressed herein. Accordingly, new claims may be formulated during prosecution of this application (or an application claiming priority thereto) to any such combination of features. In particular, with reference to the appended claims, features from dependent claims may be combined with those of the independent claims and features from respective independent claims may be combined in any appropriate manner and not merely in the specific combinations enumerated in the appended claims.

The present disclosure further contemplates that the entities responsible for the collection, analysis, disclosure, transfer, storage, or other use of such personal information data will comply with well-established privacy policies and/or privacy practices. In particular, such entities should implement and consistently use privacy policies and practices that are generally recognized as meeting or exceeding industry or governmental requirements for maintaining personal information data private and secure. For example, in the case of matching biometric snapshots to the first user identity, personal information from users should be collected for legitimate and reasonable uses of the entity and not shared or sold outside of those legitimate uses. Further, such collection should occur only after receiving the informed consent of the users. Additionally, such entities would take any needed steps for safeguarding and securing access to such personal information data and ensuring that others with access to the personal information data adhere to their privacy policies and procedures. Further, such entities can subject themselves to evaluation by third parties to certify their adherence to widely accepted privacy policies and practices.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various examples for the purpose of streamlining the disclosure. This method of disclosure is not to be interpreted as reflecting an intention that the claims require more features than are expressly recited in each claim. Rather, as the following claims reflect, inventive subject matter lies in less than all features of a single disclosed example. Thus the following claims are hereby incorporated into the Detailed Description, with each claim standing on its own as a separately claimed subject matter.

What is claimed:

1. A recoil reducing device secured to a barrel of a firearm, the recoil reducing device comprising:

a hollow outer cylinder secured to said barrel of said firearm;

a weighted cylinder;

a distal bumper located toward the muzzle;

a rear bumper located toward the breach;

a return spring disposed within said outer cylinder for biasing said weighted cylinder toward rear bumper; and a communicating port, wherein said communicating port forms a gas channel between said barrel and said outer cylinder.

2. The recoil reducing device of claim 1, wherein said weighted cylinder is slidably disposed within said outer cylinder so that said return spring is compressed whenever said weighted cylinder glides toward said distal bumper and said return spring tension is released whenever said weighted cylinder glides toward said rear bumper.

3. The recoil reducing device of claim 2, wherein said communicating port is configured to allow discharge gases to penetrate said outer cylinder and push said weighted cylinder to accelerate until said weighted cylinder forcefully strikes said distal bumper.

4. The recoil reducing device of claim 1, further comprising:

an exit port situated distal to the weighted lead cylinder allow gases in front of the lead weighted cylinder to exit as said lead cylinder is pushed forward.

5. The recoil reducing device of claim 1 wherein the hollow outer cylinder is situated in a parallel position to the gun barrel and firmly attached to it via one or more welding points.

6. The recoil reducing device of claim 1 wherein the hollow outer cylinder can be attached to the gun barrel using removable brackets located at each end of said hollow outer cylinder thereby allowing said hollow outter cylinder to be removed for maintenance.

* * * * *